US005823387A

United States Patent [19]

Manadanas et al.

[11] Patent Number: 5,823,387

[45] Date of Patent: Oct. 20, 1998

[54] METHOD AND APPARATUS FOR SIMULTANEOUSLY DISPENSING VISCOUS MATERIALS

[75] Inventors: Benjamin Yap Manadanas, Freehold; James Michael Skaggs, Bayonne; Sean Patrick O'Sullivan, Edison; Christopher John Hedin, Bridgewater, all of N.J.

[73] Assignee: Colgate-Palmolive Company, New York, N.Y.

[21] Appl. No.: 63,202

[22] Filed: May 18, 1993

[51] Int. Cl.[6] ..... B65D 35/00

[52] U.S. Cl. ..... 222/1; 222/92; 222/145.3; 222/575; 425/131.1; 425/133.1; 425/467

[58] Field of Search ..... 425/131.1, 133.1, 425/462, 467; 222/1, 92, 94, 145.3, 575

[56] References Cited

U.S. PATENT DOCUMENTS

| | | | |
|---|---|---|---|
| 2,103,111 | 12/1937 | Ekdahl | 222/575 X |
| 2,905,364 | 9/1959 | Marraffino | 222/94 |
| 2,944,705 | 7/1960 | Strumor | 222/94 |
| 2,959,327 | 11/1960 | Bloom | 222/575 X |
| 3,175,731 | 3/1965 | Ellman | 222/94 |
| 4,211,341 | 7/1980 | Weyn | 222/94 |
| 4,715,518 | 12/1987 | Moore | 222/257 |
| 4,747,517 | 5/1988 | Hart | 222/145 X |
| 4,813,862 | 3/1989 | Bowers et al. | 222/92 X |
| 4,826,044 | 5/1989 | Volfson | 222/94 |
| 4,896,796 | 1/1990 | Harris | 222/145 |
| 4,961,517 | 10/1990 | Tkac | 222/94 |
| 5,102,013 | 4/1992 | Schneider et al. | 222/94 |
| 5,307,954 | 5/1994 | Gick et al. | 222/94 |

FOREIGN PATENT DOCUMENTS

| | | | |
|---|---|---|---|
| 2243120 | 9/1973 | France . | |
| 2650252 | 2/1991 | France | 222/145 |
| 209920 | 1/1924 | United Kingdom . | |
| 1123075 | 8/1968 | United Kingdom . | |
| 2142611 | 1/1985 | United Kingdom | B67C 3/26 |
| 2161863 | 1/1986 | United Kingdom . | |

*Primary Examiner*—Kenneth Bomberg
*Attorney, Agent, or Firm*—Michael McGreal

[57] ABSTRACT

A method an apparatus for simultaneously dispensing a plurality of viscous materials, such as dentifrice pastes, produces a striped outer layer of a first material surrounding a core of a second viscous material. The apparatus includes a collapsible tube or pump-type dispenser containing a first viscous material and a second viscous material of a contrasting color in contact with the first material so that both materials are dispensed simultaneously. The tube or dispenser includes an outlet nozzle having a shaped outlet capable of scraping and removing a portion of the outer layer of viscous material to dispense the core material having stripes of the outer material. The nozzle is capable of forming a plurality of fine pin stripes on the core material.

7 Claims, 3 Drawing Sheets

METHOD AND APPARATUS FOR SIMULTANEOUSLY DISPENSING VISCOUS MATERIALS

FIELD OF THE INVENTION

The present invention is directed to a method and apparatus for simultaneously dispensing at least two different viscous materials. More particularly, the invention is directed to a method and apparatus for dispensing two different viscous materials to form an extrudate having a plurality of longitudinal stripes of one of the viscous materials.

BACKGROUND OF THE INVENTION

Containers such as collapsible squeeze tubes have been used to dispense simultaneously at least two different materials. It is desirable to package the materials so that when dispensed, the different materials appear as longitudinal stripes in the extrudate. Several containers and methods for dispensing the materials have been developed.

Many of the containers for dispensing different viscous materials include containers having separate compartments or a second container disposed within a first container where each compartment or container contains a different material. These devices typically include a dispensing nozzle having separate channels to simultaneously dispense the materials from each compartment or container. These devices, although effective, are expensive to manufacture. In addition, these dispensing containers are difficult to fill and generally require complex filling nozzles. Examples of these types of containers are disclosed in U.S. Pat. No. 4,211,341 to Weyn, U.S. Pat. No. 3,175,731 to Ellman and British Patent No. 209,920.

Other forms of containers for dispensing two different materials include a single tube such as that disclosed in U.S. Pat. No. 3,747,804 to Raaf et al. In this device the first material is placed in one end of the tube with the second material being placed in the discharge end of the tube. A dispensing nozzle is attached to the discharge end of the tube. The nozzle includes a collar extending into the tube such that a main channel leads to the first material in the lower end of the tube and a secondary channel leads to the second material in the discharge end. Pressure applied to the tube causes the two materials to be simultaneously dispensed through the nozzle. This type of dispensing is referred to as "pointing" the striping material onto a core of a base material. Another form of this type of device is disclosed in U.S. Pat. No. 4,826,044.

Still another form of dispensing device for simultaneously dispensing two different materials is disclosed in GB 2142611A. This patent shows a filling nozzle for filling a tube with two dissimilar materials arranged so that a main body of material can be dispensed from the tube with longitudinal stripes of one of the dissimilar materials. The two materials fill the tube to form a core of the first material and a plurality of streams of the striping material extending along the interior of the tube walls. This type of filling is sometimes referred to as deep striping. In this type of container, when each of the two dissimilar materials have a similar rheology, the two materials can be dispensed simultaneously through a single nozzle to form a core of the first material with stripes of the second material.

Each of these dispensing devices are effective in dispensing two different materials. While several of these devices are capable of dispensing a core of one material and longitudinal stripes of a second material, the dispensers are limited to the size of the striping which can be produced. The rheology of the material is generally such that the ratio of the two materials within the container must be within a certain range. In particular, with deep striping, the striping material must be provided in a certain amount to be dispensed with the core material. As a consequence, the dimensions of the striping must be of predetermined width and depth to dispense effectively. Furthermore, as the dimensions of the striping material within the tube decrease, the definition of the striping in the dispensed material decreases.

There is, therefore, a continuing need in the art for a dispensing device capable of dispensing two dissimilar materials to produce a core of one material having narrow striping of a second material. There is further a need in the art for a dispensing device capable of dispensing two or more materials to form a shaped extrudate.

SUMMARY OF THE INVENTION

The present invention is directed to a method and apparatus for dispensing simultaneously two or more viscous materials. The invention is further directed to a dispensing device for dispensing two or more different materials to form an extrudate having a predetermined geometric shape with selected portions of the extrudate being formed from the different materials. Accordingly, it is a primary object of this invention to dispense viscous materials such as a dentifrice paste or gel in such a manner to form a core or base of a first material having stripes of a second material. In preferred embodiments of the invention, the dentifrice comprises two or more dissimilar materials of contrasting colors. The stripes may be formed as longitudinal or spiral stripes.

These and other objects of the invention are basically attained by providing a dispensing container or tube with a dispensing nozzle having a geometric-shaped dispensing outlet. In preferred embodiments, the dispensing outlet is a polygon-shaped opening having a plurality of radially disposed points. The container is provided with two or more dissimilar materials having compatible rheologies so that each of the materials are dispensed simultaneously at a desired rate. The materials are placed in the same container in designated regions such that the materials are in contact with each other. In one embodiment, two dissimilar materials are filled in a tube such that one of the materials forms a core and the second material defines longitudinal stripes. Generally, the stripes are formed on the peripheral edge of the tube so that when the materials are dispensed, the dispensed material appears as longitudinal stripes. In alternative embodiments, the dissimilar materials are arranged as a central core and one or more outer annular layers. In preferred embodiments, each of the dissimilar materials are disposed in areas extending longitudinally to the container such that the materials extend substantially the full length of the container.

The dispensing outlet in the container is capable of shaping the materials as they are dispensed. Preferably, the radial points of the outlet are positioned to coincide with the stripes of the material in the container. As the materials are dispensed from the container through the dispensing nozzle, the radial points of the outlet essentially scrape and restrict the flow of the striping material as it is dispensed to form small and narrow stripes. The dispensing outlet may be a number of different shapes including, for example, a star shape, triangle shape, square shape or slot shape.

In one preferred embodiment, the dispensing outlet is a star shape. The container includes a plurality of stripes of one of the materials corresponding to the number of points of the star and are positioned in the container to align with the points of the star. As the materials are dispensed through the nozzle, the points of the star shape the extrudate so that the extrudate has a substantially star-shaped cross section with the tips of the star being formed from the striping material.

These and other objects and salient features of the invention will become apparent from the following detailed description which, when taken in conjunction with the drawings, discloses several preferred embodiments of the invention.

BRIEF DESCRIPTION OF THE DRAWINGS

Referring to the drawings which form part of this original disclosure in which.

DETAILED DESCRIPTION OF THE INVENTION

Figure 1:
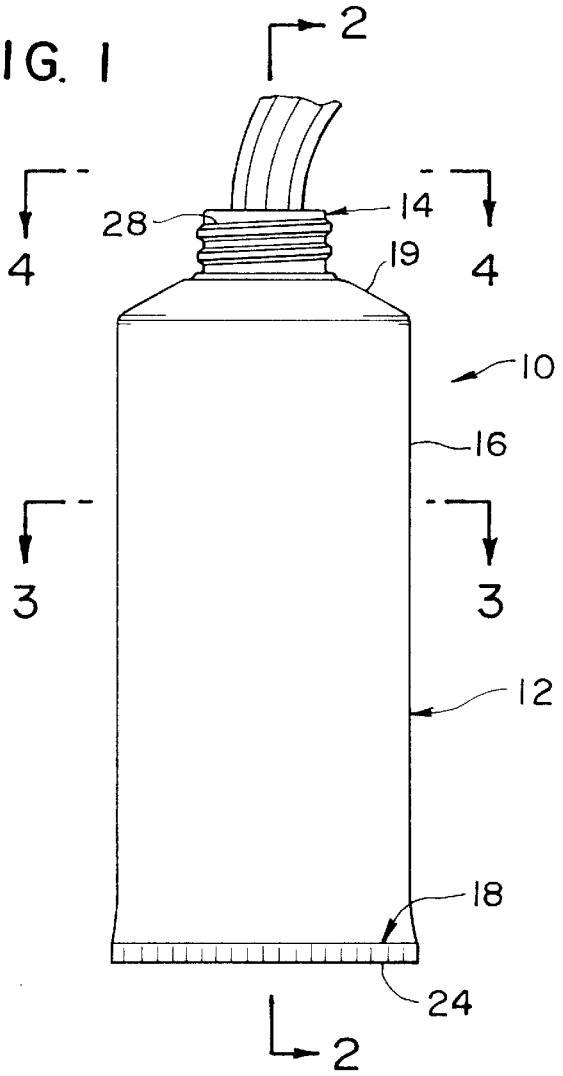
FIG. 1 is an elevated view of the container in accordance with a preferred embodiment of the invention.

The disadvantages and limitations of the previous dispensing devices are overcome by the present invention, while providing an efficient and inexpensive dispensing device for dispensing the materials in a predetermined geometric shape having longitudinal stripes. The invention is primarily directed to a container for dispensing viscous materials, and in particular, paste or gel dentifrices. Referring to FIG. 1, the dispensing device 10 comprises a container 12 for containing a viscous material and a dispensing nozzle 14.

Figure 2:
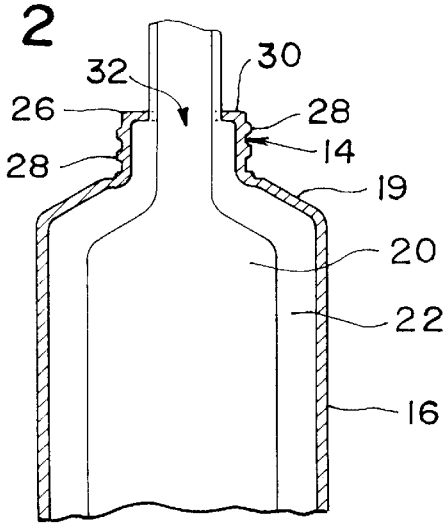
FIG. 2 is a cross-sectional view of the container taken along lines 2—2 of FIG. 1.

The container 12 may be any suitable container capable of dispensing viscous materials, and in particular for dispensing a dentifrice paste or gel. The container may be a thin-walled collapsible tube or a rigid container having a conventional pump or other mechanical dispensing apparatus. In preferred embodiments, the container is a squeeze tube made of a synthetic, multilayer plastic material such as nylon, polyethylene, polypropylene, ethylene vinyl alcohol, polyesters, and the like. The preferred containers include an inner barrier layer to prevent adsorption of flavor components or other unstable components in the viscous material. In the embodiment of FIGS. 1 and 2, the container 12 is a collapsible tube having a cylindrical side wall 16 with a closed bottom end 18 and a tapered collar 19 at the upper end, coupled to the dispensing nozzle 14. In the embodiment of FIGS. 1 and 2, the dispensing nozzle 14 is integrally molded with the sidewall of the container, although in alternative embodiments the nozzle may be molded separately such as by injection molding, and attached to the tube by conventional means.

Figure 3:
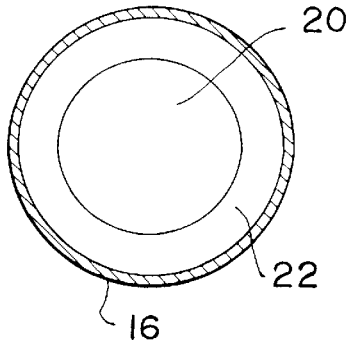
FIG. 3 is a cross-sectional view of the container taken along line 3—3 of FIG. 1.

In the embodiment of FIGS. 1–3, the container is filled with two dissimilar materials. As shown in FIGS. 2 and 3, a first viscous material 20 defines a core centered axially in the tube 12 and extending substantially the full length of the tube. A second viscous material 22 surrounds the core 20 in the form of an annular column and also extends the full length of the tube. The viscous materials are injected into the tube from the bottom end using a conventional coaxial filling nozzle as known in the art. The tube is then closed at the bottom end by crimping at 24 as shown in FIG. 1.

The dissimilar viscous materials 20, 22 in preferred embodiments are dentifrice compositions. As used herein, the term dissimilar materials is intended to refer to materials which differ in texture, composition, and particularly color. For example, the viscous materials may be an opaque dentifrice paste, a colored paste, or a translucent or clear gel. The viscous materials may also contain colored flakes, speckles or other colored bodies to enhance the aesthetic appearance of the material. In preferred embodiments, the container 14 contains at least two dissimilar compositions having contrasting colors. For example, in the embodiment of FIGS. 1–3, the first core material may be a white or pigmented paste ,and the outer material may be a colored gel of a contrasting color.

The rheology of each of the dissimilar materials are compatible with each other so that the compounds are dispensed simultaneously from the dispensing container. It is desirable to have the dissimilar materials with similar rheologies so that each material can be dispensed at the same rate. The actual dispensing rate of the materials will depend in part on the volume of each material in the container and the shape and dimensions of the dispensing outlet. The materials further have flow characteristics and slump properties to be easily dispensed from the container and retain the extruded shape for a sufficient length of time, typically about 60 seconds.

The preferred dentifrice compositions are conventional formulations as known in the art. Typical dentifrice compositions include a gelling agent, a humectant, polishing material, a surfactant, and a fluoride-providing compound. One example of a clear dentifrice comprises sodium monofluorophosphate, glycerine, sorbitol, and amorphous silica. Suitable dentifrice compositions are disclosed in U.S. Pat. No. 4,374,823; U.S. Pat. No. 4,375,460; U.S. Pat. No. 4,467,921; and U.S. Pat. No. 4,456,585.

The dispensing nozzle 14 is in the form of a collar 26 extending axially from the upper end of the tube. In preferred embodiments, the collar 26 includes external threads 28 for coupling with a standard screw cap (not shown). The nozzle 14 includes a lip 30 extending radially inward from the outer edge to define the dispensing outlet 32.

The dispensing outlet 32 is shaped and dimensioned to shape the dentifrices or other viscous materials as the materials are dispensed. The outlet 32 and the lip 30 are also dimensioned to cooperate with the dissimilar materials within the tube to shape at least one of the materials to produce a striped pattern of the second material on the core material. As shown in the embodiment of FIGS. 2 and 3, the container 12 contains two dissimilar materials arranged concentrically. The outer material 22 is forced upwardly through the collar 26 simultaneously with the core material 20. As shown in FIG. 2, the lip 30 is dimensioned to cooperate with the outer material 22 to control the amount of the material 22 being dispensed through the dispensing outlet 32 in relation to the amount of the core material 20 being dispensed. The dispensing outlet is shaped to scrape a portion of the outer material 22 from the core material 20 and restrict the flow of the outer material to produce a striped pattern of the outer material 22 on the core material 20.

In preferred embodiments, the core material and the striping material are disposed in longitudinal areas of the container and extend the full length of the container while being in continuous physical contact with each other. Both materials are dispensed simultaneously by passing through an outlet and dispensing nozzle.

Figure 4:
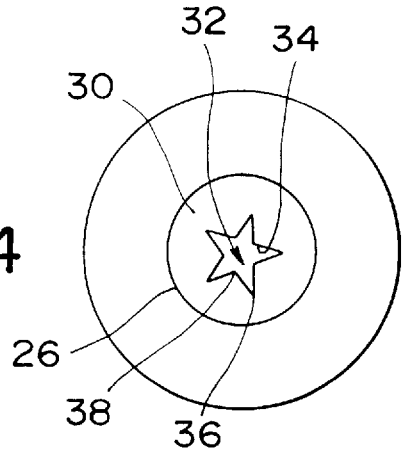
FIG. 4 is an elevated end view of the dispensing nozzle in a first embodiment of the invention.

The dispensing outlet 32 may be any shape capable of shaping the core material 20 and the outer material 22. In preferred embodiments, the dispensing outlet 32 is a polygon-shaped opening having a plurality of substantially straight sides to define a plurality of radial points. In the embodiment of FIGS. 1–4, the dispensing outlet 32 is a star-shaped opening. The star-shaped opening as shown in FIG. 4 is formed by side edges 34 which define radial points 36 of the star and troughs 38 between the points 36.

Figure 4A:
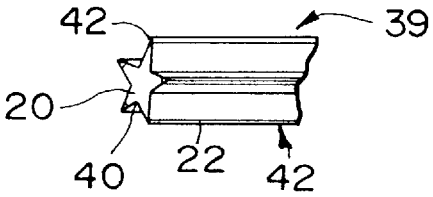
FIG. 4A is a perspective view of the material having been dispensed from the nozzle of FIG. 4, showing a star shape with the tips of the star having longitudinal stripes.

The two dissimilar materials 20 and 22 are dispensed simultaneously through the star-shaped opening to form a star-shaped extrudate 39 as shown in FIG. 4A. The radial distance between the troughs 38 and the points 36 of the star-shaped outlet 32 is selected to define the pattern of the dissimilar materials as they are dispensed. In the embodiment of FIG. 4, the troughs 38 of the star-shaped opening extend inwardly a sufficient distance to remove a portion of the outer material 22 from the core material 20 while dispensing the materials so that the trough 40 of the star-shaped extrudate are formed from the core material 20. The points 36 of the star-shaped openings are positioned to allow a predetermined amount of the outer material 22 to be dispensed as points 42 of the extruded star which appear as longitudinal stripes as shown in FIG. 4A. In preferred embodiments, the points 42 of the star-shaped outlet are aligned with the inner wall of the collar 26. This embodiment is referred to as the stars and stripes embodiment.

The position and dimension of the longitudinal stripes 42 of the extrudate can be controlled by the shape and dimension of the dispensing outlet, the placement of the dissimilar materials in the container, and the respective amounts of each material. The angle of the sides 34 with respect to each other which define the points of the star can be varied to control the width and depth of the stripes on the core. For example, a larger angle between the sides will produce wide stripes in the extruded material. In a similar manner, a small angle between the sides of the star will produce a fine, narrow pin stripe which is generally deeper than the stripes formed by the wider-angled sides. The polygon-shaped outlet is able to produce a plurality of fine stripes of one of the viscous materials without loss of definition which cannot be produced by filling the container with stripes or columns of the dissimilar materials and dispensing the materials through a standard annular outlet.

Figure 5:
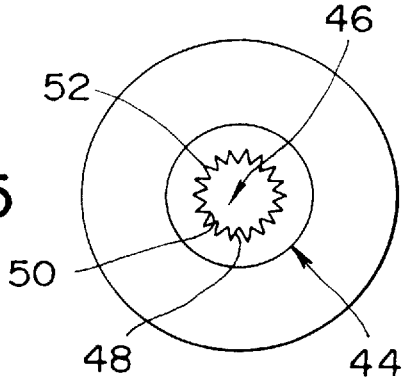
FIG. 5 is an elevated end view of a dispensing nozzle in a second embodiment of the invention.
Figure 5A:
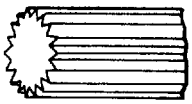
FIG. 5A is a perspective view of the material having been dispensed from the nozzle of FIG. 5 showing a plurality of fine longitudinal stripes.

In a further embodiment illustrated in FIG. 5, the dispensing nozzle 44 includes a dispensing outlet 46 having a plurality of side edges 48 defining a substantially serrated outlet. In this embodiment, it is desirable to fill the container with two dissimilar materials as concentric columns in the manner shown in FIGS. 2 and 3. The side edges 48 converge to define a plurality of alternating troughs 50 and points 52. The viscous materials are dispensed through the serrated outlet so that the troughs 50 remove a portion of the outer annular layer of material to expose the core material. The outer annular material is similarly dispensed through the points 52 to produce an extrudate having a plurality of fine stripes of the outer material on a core of the inner material as shown in FIG. 5A.

Figure 6:
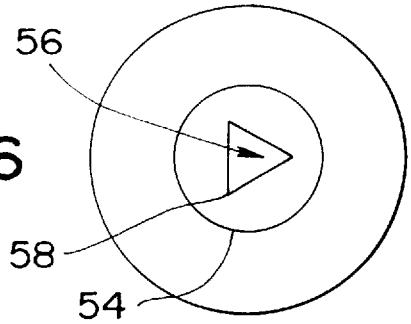
FIG. 6 is an elevated end view of the dispensing nozzle in a third embodiment of the invention.
Figure 6A:
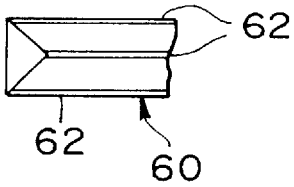
FIG. 6A is a perspective view of the material having been dispensed from the nozzle of FIG. 6 showing the longitudinal stripes.
Figure 7:
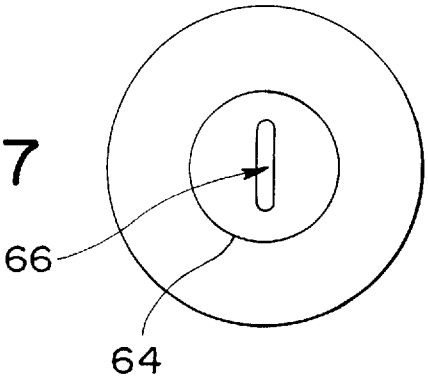
FIG. 7 is an elevated end view of a fourth embodiment of the invention.
Figure 7A:
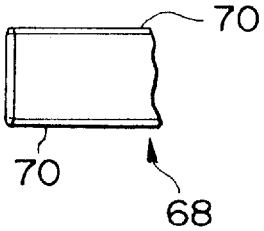
FIG. 7A is a perspective view of the material dispensed from the nozzle of FIG. 7 showing the two longitudinal stripes.

In a further embodiment shown in FIGS. 6 and 6A, the dispensing nozzle 54 includes a triangular-shaped dispensing outlet 56. In a similar manner as in the embodiments of FIGS. 1–5, the points 58 of the triangular-shaped dispensing outlet 56 produce a triangular extrudate 60 having the points 62 of the extrudate formed from the outer material. FIGS. 7 and 7A show a further alternative embodiment where the nozzle 64 includes a dispensing outlet 66 in the shape of an elongated slot. The viscous materials are dispensed from the outlet 66 in the form of strip 68 having longitudinal stripes 70 along the outer edges.

Figure 8:
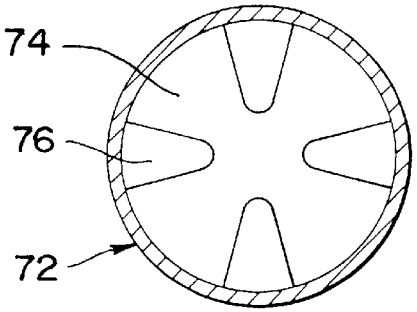
FIG. 8 is a cross-sectional view of a container in a further embodiment of the invention showing the two different materials in the container arranged to form longitudinal stripes.
Figure 9:
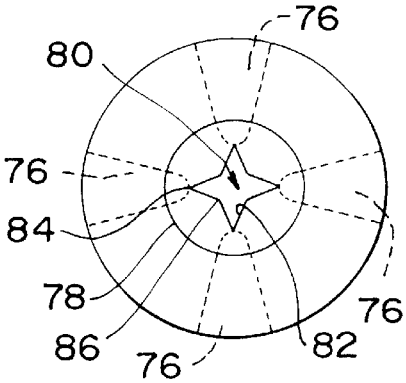
FIG. 9 is an end view of the dispensing nozzle in a further embodiment.

In a further embodiment illustrated in FIG. 8, a tube 72 is filled with a core material 74 and columns of a striping material 76 disposed around the outer peripheral edge. The striping material forms longitudinal stripes or columns in the container. The two dissimilar materials are dispensed through the nozzle simultaneously. This arrangement of the two dissimilar materials is typically referred to as deep striping. A dispensing nozzle 78 as shown in FIG. 9 includes a four-point star-shaped dispensing outlet 80. The outlet 80 includes a plurality of side edges 82 defining the points 84 and troughs 86 of the star. The striping material 76 is positioned in the tube to be aligned with the points 84 of the star-shaped outlet as shown by phantom lines in FIG. 9.

The arrangement of the core material 74 and the striping material 76 in the tube 72 allow the materials to move through the dispensing nozzle 78 as a column of the core material 74 with stripes of the striping material 76 until the materials reach the dispensing outlet 80. As the materials pass through the dispensing outlet 80, the troughs 86 of the outlet 80 shape the materials to form the extrudate 88 into a star shape where the troughs 90 of the extrudate are formed from the core material. The points 84 of the outlet 80 shape the striping material 76 to form the points 92 of the extrudate as shown in FIG. 9B.

Figure 9A:
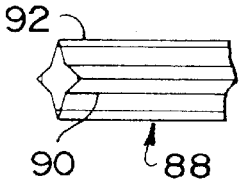
FIG. 9A is a perspective view of the material dispensed from the nozzle showing the longitudinal stripes.
Figure 10:
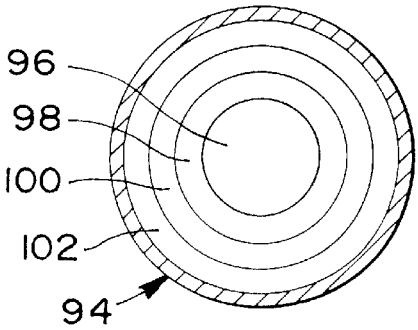
FIG. 10 is a cross-sectional view of the container in a further embodiment showing the different materials arranged as concentric annular columns.
Figure 10A:
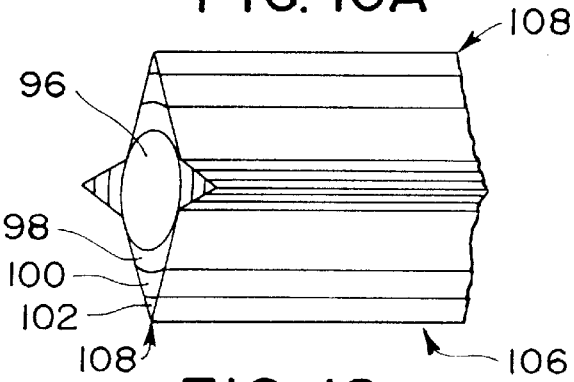
FIG. 10A is a perspective view of the material having been dispensed and showing the annular stripes.

In a further alternative embodiment shown in FIG. 10, the tube 94 contains four dissimilar viscous materials 96, 98,

100 and 102 arranged as concentric annular columns. The four materials may be dispensed through a nozzle as in FIG. 9A to produce an extrudate 106 having a star shape where the arms 108 of the star are made up of the four materials such that each material is visible.

Figure 11:
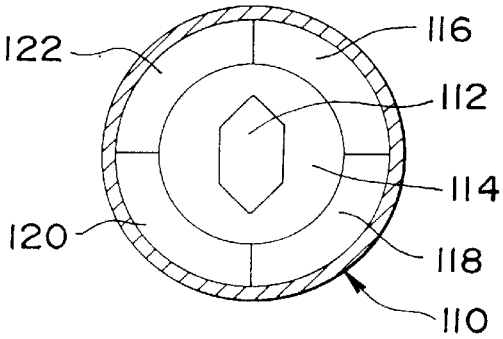
FIG. 11 is a cross-sectional view of the container in a further embodiment showing the materials arranged as a center core, a middle annular core, and an outer annular core divided into four wedge-shaped columns of different colors.

Numerous arrangements and any number of dissimilar materials may be used to produce different effects in the extrudate. It is particularly desirable to use materials having contrasting colors. For example, in a further embodiment illustrated in FIG. 11, the tube 110 contains six dissimilar materials. In this embodiment, a core material 112 is surrounded by an annular column 114 of a clear material. An outer annular layer being made up of four arcuate columns 116, 118, 120 and 122 surround the column 114. These materials may be dispensed through a dispensing outlet as in FIG. 9 to produce a star-shaped extrudate having each of the arms making up the star formed from one of the dissimilar materials. The body of the star being formed from the transparent material 114 allows the core material 112 to be visible.

Figure 12:
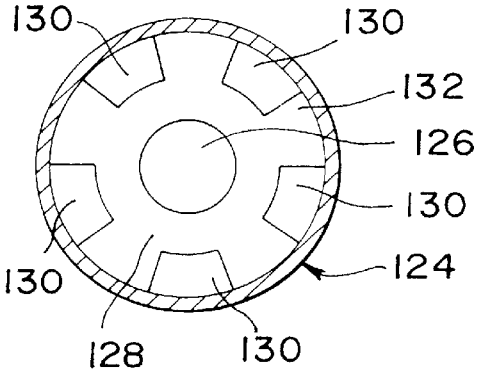
FIG. 12 is a cross section of a further embodiment of the container showing a center core and an outer core where the outer core includes five spaced apart longitudinal columns of different materials.

In a further embodiment illustrated in FIG. 12, a tube 124 contains three dissimilar materials. A core material 126 of a first color is surrounded by an annular column 128 of a second material having a second color. Five spaced apart columns 130 of a third material of a third color are arranged around the peripheral edge of the second material 128. These materials may be dispensed in cooperation with a dispensing outlet as shown in FIG. 4 with the points of the stars aligned with the space 132 between the columns 130. When dispensed, the body of the star-shaped extrudate will be formed from the core material 126 with the sides of the arms of the star formed from the material 128 and the tips of the star formed from the third material 130.

Figure 13:
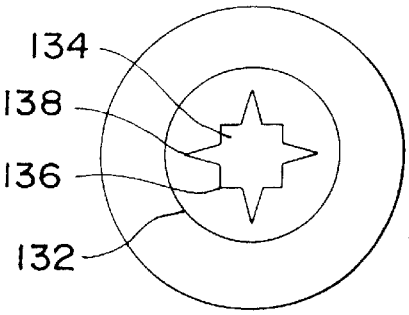
FIG. 13 is an end view of the dispensing nozzle in a further embodiment showing a dispensing outlet having a plurality of alternating long and short radial legs.
Figure 13A:
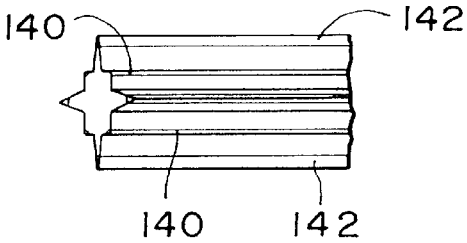
FIG. 13A is a perspective view of the material dispensed from the nozzle of FIG. 13.

In a further embodiment of the invention shown in FIG. 13, the dispensing nozzle 132 includes a dispensing outlet 134 having a star-like shape defined by alternating short peaks 136 and long peaks 138. When two materials are arranged as concentric columns as shown in FIG. 3, the dispensed materials produce a star-shaped extrudate having narrow stripes 140 formed by the short peaks 136 and dominant, broad stripes 142 formed from the long peaks 138.

It will be recognized that various arrangements and shapes of the dispensing outlet and the materials in the container can be made. In one embodiment, the outer material can be a colored translucent material or transparent material having colored bodies therein which can be dispensed as a thin layer on the core material so that the core is also visible.

Numerous other embodiments can be produced to form an extrudate having a desired shape and number of longitudinal stripes. By filling the container with two or more dissimilar materials and dispensing the materials through the polygon-shaped outlet, the position and dimension of the striping can be controlled. While several embodiments have been illustrated, it will be apparent to one skilled in the art that numerous alternative embodiments can be envisioned without departing from the scope of the invention as defined in the following claims.

What is claimed is:

1. A method of dispensing viscous materials comprising providing a container having a core of a first viscous material and a second viscous material surrounding said core; and dispensing said first and second materials simultaneously through a dispensing means, said dispensing means including shaping means for shaping only said second material to form a plurality of stripes on said first material.

2. The method of claim 1, wherein said shaping means includes means for removing a portion of said second material from said column during dispensing to expose at least a portion of said core.

3. The method of claim 1, wherein said shaping means includes a dispensing outlet, said outlet having a serrated inner edge whereby said dispensing of said first and second materials produces a core of said first material and a plurality of stripes of said second material on said core.

4. The method of claim 2, wherein said shaping means includes a dispensing star shaped outlet.

5. The method of claim 2, wherein said shaping means includes a dispensing outlet having a polygonal shape.

6. The method of claim 2, wherein said shaping means includes a dispensing outlet having an elongated slot for dispensing said first and second materials.

7. The method of claim 5, wherein said dispensing outlet includes a plurality of alternating first and second arms, said first arms having a radial length greater than the radial length of said second arms, said method comprising dispensing said materials through said dispensing outlet and producing an extrudate having a plurality of first longitudinal stripes formed from said first arms and a plurality of second longitudinal stripes formed from said second arms.

* * * * *